US010839665B2

(12) United States Patent
Potucek et al.

(10) Patent No.: US 10,839,665 B2
(45) Date of Patent: Nov. 17, 2020

(54) UNDERWATER LIGHTING SYSTEM WITH BATHER DETECTION CIRCUITRY

(71) Applicant: Hayward Industries, Inc., Berkeley Heights, NJ (US)

(72) Inventors: Kevin L. Potucek, Far Hills, NJ (US); Stuart Baker, Westfield, NJ (US)

(73) Assignee: Hayward Industries, Inc., Berkeley Heights, NJ (US)

( * ) Notice: Subject to any disclaimer, the term of this patent is extended or adjusted under 35 U.S.C. 154(b) by 0 days.

(21) Appl. No.: 16/181,063

(22) Filed: Nov. 5, 2018

(65) Prior Publication Data

US 2019/0073889 A1 Mar. 7, 2019

Related U.S. Application Data

(63) Continuation-in-part of application No. 14/205,936, filed on Mar. 12, 2014, which is a continuation-in-part of application No. 13/840,751, filed on Mar. 15, 2013, now abandoned.

(51) Int. Cl.
*G08B 21/08* (2006.01)
*G08B 5/36* (2006.01)

(52) U.S. Cl.
CPC ..... *G08B 21/08* (2013.01); *G08B 5/36* (2013.01)

(58) Field of Classification Search
CPC ..... F21W 2131/401; F21W 2121/02; E04H 4/148; F21S 8/00; F21V 23/00; F21V 23/02; F21V 31/005; F21V 7/04; F21V 33/0056; F21V 15/01; F21V 7/043; F21V 33/00; F21V 17/06; G02B 6/0096;
(Continued)

(56) References Cited

U.S. PATENT DOCUMENTS 5,023,593 A 6/1991 Brox
5,195,060 A 3/1993 Roll
5,408,222 A 4/1995 Yaffe et al.
(Continued)

FOREIGN PATENT DOCUMENTS

IL 256138 1/2018
WO 02/061330 A2 8/2002
(Continued)

OTHER PUBLICATIONS

Office Action dated Mar. 13, 2014, issued in connection with U.S. Appl. No. 13/840,751 (11 pages).
(Continued)

*Primary Examiner* — Tracie Y Green
(74) *Attorney, Agent, or Firm* — McCarter & English, LLP

(57) ABSTRACT

The present disclosure relates to a lighting fixture for use in connection with a swimming pool or spa. The lighting fixture includes a light source, and a detection device for detecting the presence of a bather in a pool or a spa. A microprocessor is in electrical communication with the detection device and the light source. The microprocessor adjusts an output of the light source when a bather is detected in the pool or the spa. The microprocessor could adjust the color of the light emitted by the light source when a bather is detected. Also provided is a bather condition/activity detection system which utilizes pool or spa devices to detect various bather conditions/activities such as bather ingress, egress, drowning, distress, etc.

6 Claims, 6 Drawing Sheets

(58) Field of Classification Search
CPC ..... G02B 6/0031; G08B 5/36; G10L 15/30; G10L 15/22; G10L 2015/223; F21Y 2115/10
See application file for complete search history.

(56) References Cited

U.S. PATENT DOCUMENTS

| | | | | |
|---|---|---|---|---|
| 6,327,220 | B1 | 12/2001 | Miller, Jr. et al. | |
| 6,441,558 | B1 | 8/2002 | Muthu et al. | |
| 6,788,011 | B2 | 9/2004 | Mueller et al. | |
| 6,949,894 | B1 | 9/2005 | Sullivan et al. | |
| 6,980,109 | B2 | 12/2005 | Hoenig | |
| 7,019,649 | B2 | 3/2006 | Hoenig | |
| 7,427,923 | B2 | 9/2008 | Durand | |
| 7,550,935 | B2 | 6/2009 | Lys et al. | |
| 7,719,209 | B2 | 5/2010 | Hayes | |
| 7,726,869 | B2 | 6/2010 | Chien | |
| 8,198,826 | B2 | 6/2012 | Lin et al. | |
| 8,970,372 | B2 | 3/2015 | Primous et al. | |
| 9,508,242 | B2 | 11/2016 | Podlisker | |
| 9,640,058 | B1 * | 5/2017 | Bollman | G08B 21/084 |
| 10,127,362 | B2 | 11/2018 | Bennett et al. | |
| 2002/0135476 | A1 | 9/2002 | McKinney et al. | |
| 2003/0034284 | A1 * | 2/2003 | Wolfe | A61H 33/6073 210/85 |
| 2003/0222782 | A1 | 12/2003 | Gaudreau | |
| 2003/0227439 | A1 | 12/2003 | Lee et al. | |
| 2005/0128751 | A1 | 6/2005 | Roberge et al. | |
| 2008/0080168 | A1 * | 4/2008 | Harris | F21S 8/00 362/101 |
| 2008/0106422 | A1 * | 5/2008 | Sparks | E04H 4/14 340/573.6 |
| 2008/0197788 | A1 | 8/2008 | Conover et al. | |
| 2009/0219785 | A1 * | 9/2009 | Van ''T Klooster | G01S 5/30 367/124 |
| 2009/0295566 | A1 * | 12/2009 | Weintraub | G08B 21/088 340/539.11 |
| 2011/0121654 | A1 | 5/2011 | Recker et al. | |
| 2012/0106149 | A1 | 5/2012 | Boa | |
| 2014/0013499 | A1 | 1/2014 | Steinman et al. | |
| 2014/0210373 | A1 | 7/2014 | Baret | |
| 2014/0265842 | A1 | 9/2014 | Potucek et al. | |
| 2014/0268678 | A1 | 9/2014 | Potucek et al. | |
| 2019/0087548 | A1 | 3/2019 | Bennett et al. | |

FOREIGN PATENT DOCUMENTS

| | | | |
|---|---|---|---|
| WO | 2004/023034 | A1 | 3/2004 |
| WO | 2004/100624 | A2 | 11/2004 |
| WO | 2006/093889 | A2 | 9/2006 |
| WO | 2008/067402 | A2 | 6/2008 |
| WO | 2019/111256 | A1 | 6/2019 |

OTHER PUBLICATIONS

International Search Report of the International Searching Authority dated Jul. 21, 2014, issued in connection with International Application No. PCT/US2014/24538 (2 pages).
Written Opinion dated Jul. 21, 2014, issued in connection with International Application No. PCT/US2014/24538 (5 pages).
Office Action dated Sep. 18, 2014, issued in connection with U.S. Appl. No. 13/840,751 (12 pages).
Office Action dated Dec. 23, 2014, issued in connection with U.S. Appl. No. 14/205,936 (17 pages).
Office Action dated Jul. 24, 2015, issued in connection with U.S. Appl. No. 13/840,751 (12 pages).
Office Action dated Jul. 24, 2015, issued in connection with U.S. Appl. No. 14/205,936 (15 pages).
Office Action dated Apr. 12, 2016, issued in connection with U.S. Appl. No. 14/205,936 (17 pages).
Office Action dated Jul. 20, 2016, issued in connection with U.S. Appl. No. 13/840,751 (11 pages).
Extended EuropeanSearch Report dated Nov. 16, 2016, issued in connection with European Application No. 14768587.9 (9 pages).
Office Action dated Jan. 10, 2017, issued in connection with U.S. Appl. No. 14/205,936 (20 pages).
Office Action dated Mar. 13, 2017, issued in connection with U.S. Appl. No. 13/840,751 (12 pages).
Office Action dated Nov. 3, 2017, issued in connection with U.S. Appl. No. 14/205,936 (22 pages).
Office Action dated Feb. 12, 2018, issued in connection with U.S. Appl. No. 13/840,751 (13 pages).
Office Action dated Aug. 10, 2018, issued in connection with U.S. Appl. No. 14/205,936 (20 pages).
Office Action dated Oct. 19, 2018, issued in connection with U.S. Appl. No. 13/840,751 (15 pages).
Office Action dated Feb. 19, 2019, issued in connection with U.S. Appl. No. 14/205,936 (24 pages).
Office Action dated Mar. 18, 2019, issued in connection with U.S. Appl. No. 13/840,751 (19 pages).
Office Action dated Aug. 14, 2019, issued in connection with U.S. Appl. No. 14/205,936 (17 pages).
Examination Report dated Oct. 18, 2019, issued by the European Patent Office in connection with European Application No. 14768587.9 (9 pages).
International Search Report of the International Searching Authority dated Dec. 18, 2019, issued in connection with International Application No. PCT/US2019/059914 (3 pages).
Written Opinion of the International Searching Authority dated Dec. 18, 2019, issued in connection with International Application No. PCT/US2019/059914 (3 pages).
Office Action dated Mar. 3, 2020, issued in connection with U.S. Appl. No. 14/205,936 (20 pages).
Office Action dated Sep. 18, 2020, issued in connection with U.S. Appl. No. 14/205,936 (21 pages).

* cited by examiner

UNDERWATER LIGHTING SYSTEM WITH BATHER DETECTION CIRCUITRY

RELATED APPLICATIONS

This application is a continuation-in-part of U.S. Non-Provisional application Ser. No. 14/205,936 filed on Mar. 12, 2014, which is a continuation-in-part of U.S. Non-Provisional application Ser. No. 13/840,751 filed on Mar. 15, 2013, the entire disclosures of which are expressly incorporated herein by reference.

FIELD OF THE DISCLOSURE

The present disclosure relates to underwater lighting systems, and more particularly to lighting systems with bather detection circuitry for use in swimming pools, spas and the like.

RELATED ART

In-ground commercial and residential swimming pools and spas are often installed with lights, typically in a horizontal row a short distance below the waterline. These lights conventionally were standard white lights. More recently, color-changing lights have been used, with programmable controllers for turning selected lights on and off, effectively producing an underwater light show for the pool's bathers and bystanders/spectators. Adequate lighting in pools and spas is important for safety reasons for bathers. There is a generally a higher standard of pool/spa illumination for safe active bather use and a lesser standard for safe pool/spa illumination for bystanders/spectators.

In a typical application, an underwater light fixture (also called a luminaire) includes an array of light-emitting diodes (LEDs) coupled to a microprocessor. LEDs are available in various colors (e.g., red, green, blue, white, etc.). A specific color in a light fixture may be obtained by powering different LEDs in combinations of primary colors (e.g., LEDs in red, green and blue). The light fixture could be programmed to change colors at certain time intervals.

In certain jurisdictions, commercial and residential swimming pools and spas may have minimum illumination requirements for safe use. While color-changing LED lights have a pleasing visual effect, they may emit lumens in certain color modes that are below the minimum illumination requirements. As such, existing color LED pool and spa lights may not be suitable for use in certain applications because they do not meet applicable lighting codes. It is therefore desirable to provide a lighting system where the color-changing LED light may automatically change its output so that the light emits a sufficient amount of lumens when bathers are in a pool or spa.

SUMMARY

In accordance with the present disclosure, a lighting fixture is provided for use in connection with a swimming pool or spa. In particular, the lighting fixture includes a light source, and a detection device for detecting the presence of a person within a pool or spa. The detection device transmits a signal into the pool/spa water, and receives a reflected signal from a bather in the pool or spa to detect the presence of the bather. A microprocessor is in electrical communication with the detection device and the light source. The microprocessor adjusts an output of the light source when the bather is detected, so that sufficient light output is generated by the underwater lighting fixture.

In accordance with another embodiment, a lighting system for use in connection with a swimming pool or spa is provided. The lighting system includes a lighting fixture with a light source, a microprocessor for controlling the light source, and a mechanism for detecting the presence of a person within a pool or a spa. The microprocessor changes the color of light emitted from the light source such that the light source emits white color when the bather is detected within the pool or spa.

In another embodiment, a method for controlling a lighting fixture in a swimming pool or spa is provided. The method includes the steps of illuminating a pool or spa with a lighting fixture, detecting the presence of a person in the pool or spa, and changing the color output of the lighting fixture to an acceptable lighting condition (e.g., white light output, white and/or color output at acceptable lumen level, etc.) when a person is detected in the pool or spa.

The present invention further relates to a bather condition/activity detection system for a pool or spa, comprising: a pool or spa device positionable at least partially within water of a pool or spa; an acoustic sensor associated with the pool or spa device and configured to sense underwater sound and produce a signal indicative of the underwater sound; and a processor in communication with the acoustic sensor and configured to analyze the signal to determine if a bather condition/activity is present in the pool or spa, wherein the processor issues an instruction to perform an action upon a determination that a bather condition/activity is present in the pool or spa.

BRIEF DESCRIPTION OF THE DRAWINGS

The foregoing features of the present disclosure will be apparent from the following Detailed Description, taken in connection with the accompanying drawings, in which.

DETAILED DESCRIPTION

The present disclosure relates to an underwater color-changing light fixture having detection circuitry for detecting bathers in a swimming pool, spa, or the like. When the detection circuitry detects a bather, the light fixture automatically changes the color of the emitted light such that the light fixture emits a constant light having a fixed color, such as white light.

Figure 1:
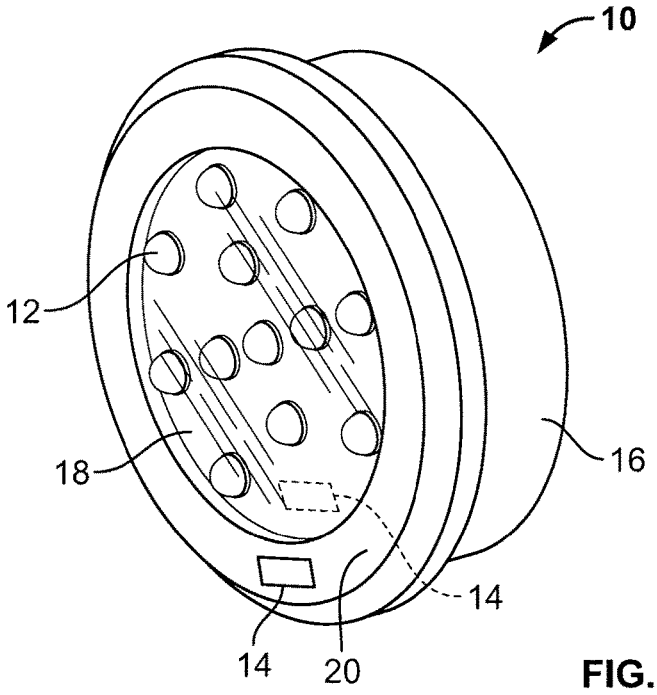
FIG. 1 is a perspective view showing an underwater color-changing light fixture with bather detection circuitry in accordance with the present disclosure.

FIG. 1 is a perspective view showing an underwater color-changing light fixture 10 of the present disclosure. The light fixture 10 includes one or more light emitting diodes (LEDs) 12 as a light generator and is adapted to be submersed underwater for providing underwater illumination. The light fixture 10 could employ differently colored LEDs 12 (e.g., red LEDs, green LEDs, blue LEDs, and white LEDs) and could be adapted to generate a variety of different colors, including white. A specific color could be obtained by powering different LEDs in combinations of primary colors (e.g., LEDs in red, green, and blue). The use of LEDs is only exemplary. It will be understood that the light fixture 10 could include a light source that is not LED-based, and/or a light source that is a combination of LED-based and non LED-based.

The light fixture 10 could include a detection device 14 located in the body 16 of the light fixture 10, behind a central lens portion 18, or in a bezel 20 positioned about the central lens portion 18. Alternatively, the detection device 14 could be located remotely from the light fixture 10, such as in any location within the vicinity of a pool or spa, or in a niche or a recess in the pool or spa that contains the light fixture 10. The detection device 14 senses the presence of a person in a swimming pool or spa by conventional methods, such as by detecting the movement of water in the pool or spa, or by detecting infrared energy, ultrasonically, etc. The detection device 14 could be any type of sensor or detector, such as a passive and/or active sonar detector, an infrared sensor, a thermal sensor, a wave sensor, an acoustic sensor, a temperature sensor, a vibration sensor, a photosensor, a light sensor, a piezoelectric device, a transducer, or a motion detector. When the detection device 14 detects the presence of a person in a swimming pool, the light fixture 10 automatically changes or calibrates the color and/or intensity of the light such that the light fixture 10 emits a constant light having a fixed color, such as white light.

Figure 2:
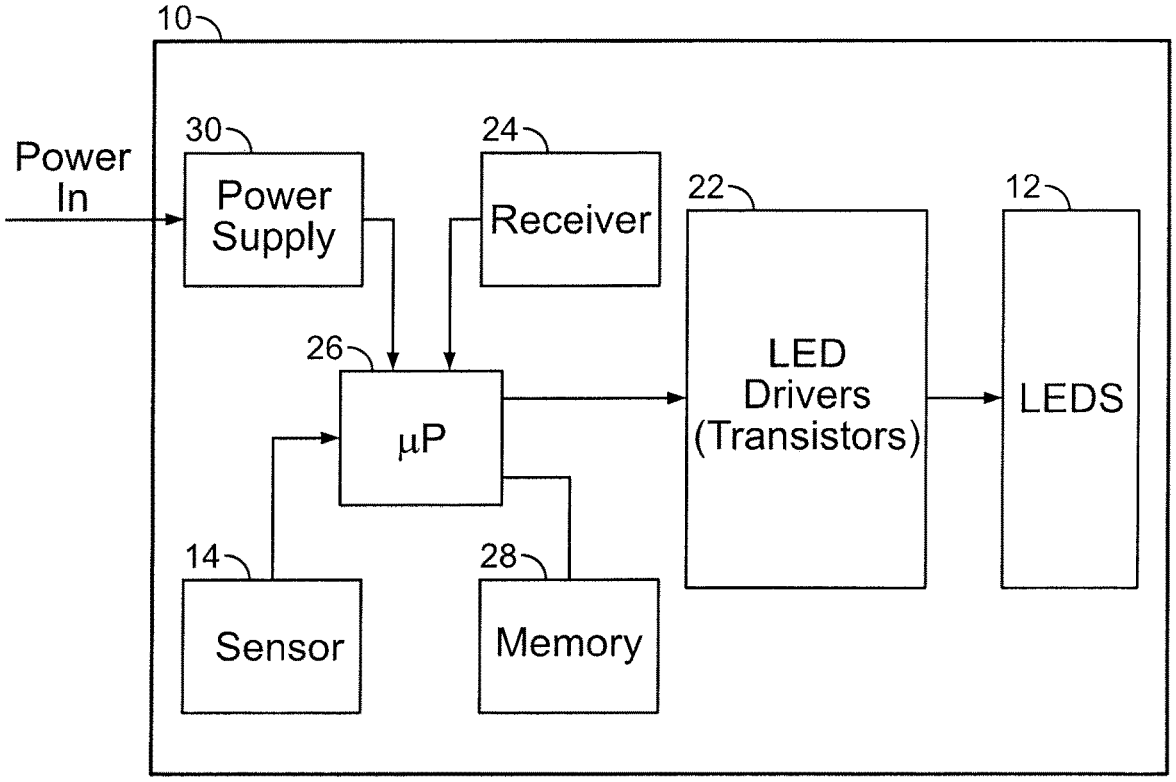
FIG. 2 is a block diagram of the light fixture of light fixture of FIG. 1.

FIG. 2 is a block diagram of a light fixture 10 according to an embodiment of the present disclosure. The light fixture 10 includes several types of electrical components, such as the LEDs 12, transistors 22 for driving the LEDs 12, the detection device (sensor) 14, a receiver 24, a microprocessor 26, one or more memories 28, and a power supply 30. The memory 28 stores preset light programs and/or algorithms for controlling output of the fixture 10. The power supply 30 provides power to the microprocessor 26 and to the light fixture 10.

The microprocessor 26 controls the color of the light emitted from the LEDs 12, as disclosed in co-pending U.S. patent application Ser. No. 11/946,685, the entire disclosure of which is expressly incorporated herein by reference. In particular, the microprocessor 26 executes programs that could be a list of colors (i.e., a set of steps) to be played back in order and a time between the steps. The programs could include one or more color-changing light programs. When one of the color-changing light programs is executed, the light fixture 10 generates a lightshow by sequentially producing lights having predetermined colors, each color displayed for a certain period of time. For example, the light fixture 10 could sequentially generate a light having a red color, a light having a blue color, and a light having a white color, each color displayed for two seconds. Additionally, the programs could include one or more fixed light programs. When one of the fixed light programs is selected, the light fixture 10 generates a constant light having a fixed color. For example, the light fixture 10 could transmit a constant light having a blue color.

The microprocessor 26 is in communication with the detection device 14. In particular, the microprocessor 26 receives reflected signals that have been emitted from the detection device 14, processes the signal, and adjusts the color of the light emitted from the LEDs 12 when a bather has been detected. In one embodiment, the microprocessor 26 adjusts the color of light emitted from the LEDs 12 based on the signal received from the detection device 14 such that the light fixture 10 transmits a constant light having an acceptable lumen output (e.g., white light or color light). Optionally, a separate receiver 24 could be provided for receiving/detecting reflected signals from a bather.

The microprocessor 26 could adjust or calibrate parameters of the LEDs 12, other than color. For example, the microprocessor 26 could adjust the brightness of the light emitted from the LEDs 12 and/or other parameters of the LEDs 12 such that the light fixture 10 transmits a light having a brightness, intensity, and/or color sufficient to satisfy the minimum illumination requirements of applicable lighting codes. The microprocessor 26 could transmit a signal to LED transistors 22 that drive the LEDs 12.

In one embodiment, a signal from one light fixture could be transmitted over a network to the receiver of another light fixture. Any type of networking mechanisms (e.g., wired, wireless, optical communication) could be utilized for allowing communication between one or more stand-alone sensors and one or more light fixtures, between two or more light fixtures, and/or between one or more light fixtures and a central controller.

Figure 3:
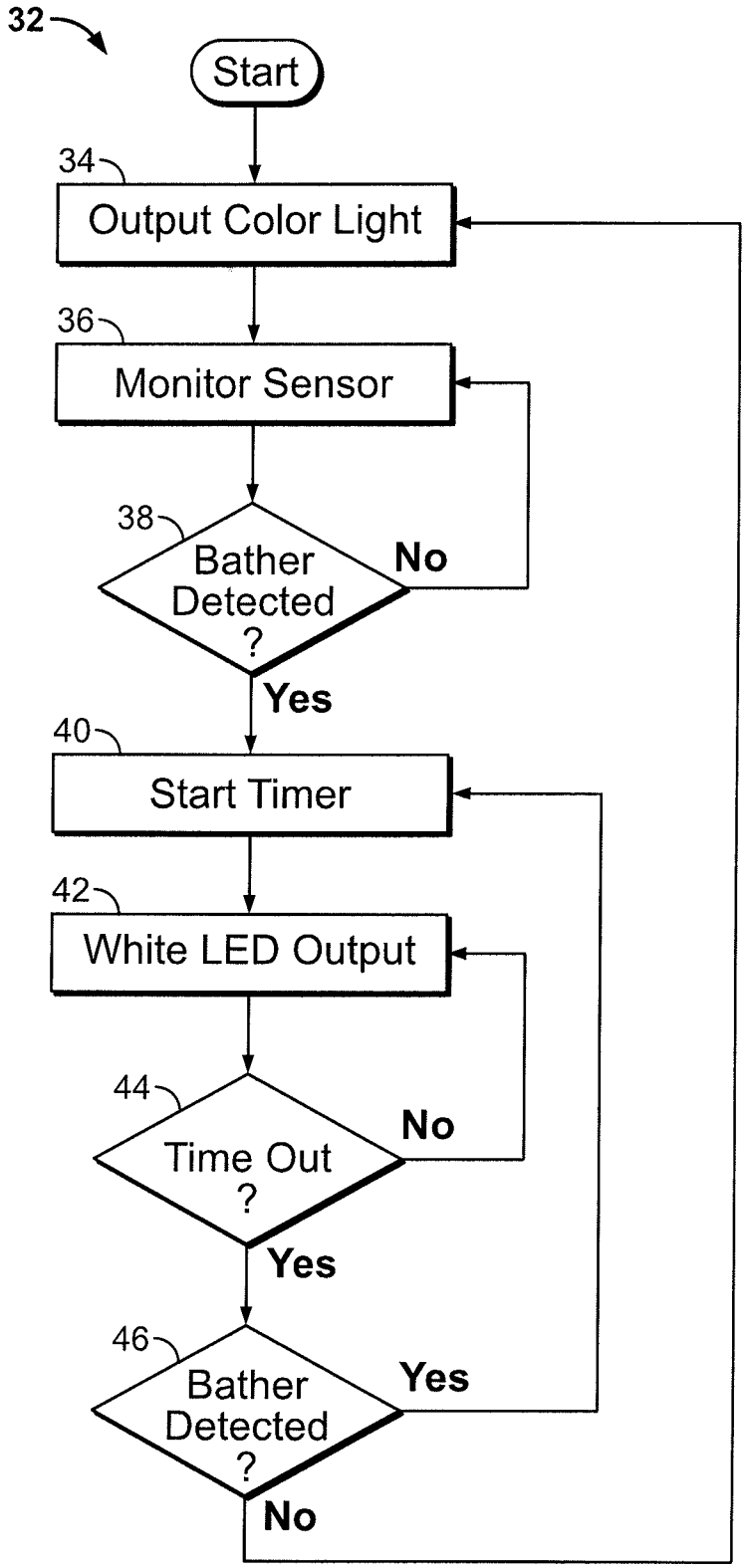
FIG. 3 is a flowchart showing processing steps according to an embodiment of the present disclosure for detecting a bather in a pool or spa and controlling output of an underwater pool/spa light based on detection of a bather.

FIG. 3 is a flowchart showing processing steps according to an embodiment of the present disclosure, indicated generally at 32, for controlling lights in a pool or spa. In step 34, the color-changing light fixture 10 produces lights having predetermined colors, while, in step 36, the microprocessor 26 simultaneously monitors the detection device, such as the sensor 14. In step 38, a determination is made as to whether a bather is detected in a swimming pool or spa. This determination is accomplished with the use of the sensor 14 detecting a parameter associated with the presence of a bather. If a negative determination is made, control returns to step 36. Otherwise, if a positive determination is made in step 38, step 40 occurs, wherein the microprocessor 26 initiates a timer for a predetermined period of time. Then or concurrently with the initiation of the timer, the microprocessor 26 adjusts the color of the light emitted from the LEDs 12 based on the sensor 14 such that a fixed light program is executed in step 42. In the example shown in FIG. 3, the light fixture 10 transmits a constant light output having a white color. In step 44, a determination is made as to whether a timeout has occurred (e.g., whether the predetermined period of time has expired). If a negative determination is made, processing reverts to step 42. Otherwise, in step 46, another determination is made as to whether a bather is detected in a swimming pool or spa. This is accomplished using the sensor 14. If a negative determination is made, control returns to step 34, wherein the light fixture 10 emits lights having predetermined colors while the microprocessor 26 monitors the sensor 14. Otherwise, if a positive determination is made in step 46, control returns to step 40, wherein the microprocessor 26 initiates the timer for another predetermined period of time. The processing steps shown in FIG. 3 allow a light fixture 10 to automatically change to full lumen white light when bathers are in a pool or spa.

In one embodiment, the sensor 14 senses one or more parameters associated with the operation of the pool, spa, or light. These parameters could include, for example, lumen performance, lumen output, amount of lumen depreciation, lighting component temperature, water temperature, flow rates, chlorination levels, pH levels, etc. If the microprocessor 26 determines that the parameter falls outside of a predetermined range based on a signal from the sensor 14, the light fixture 10 could automatically transmit a constant light, such as a white color. The constant light could serve as an alarm to indicate that there is an issue with the pool, spa, or light.

Figure 4:
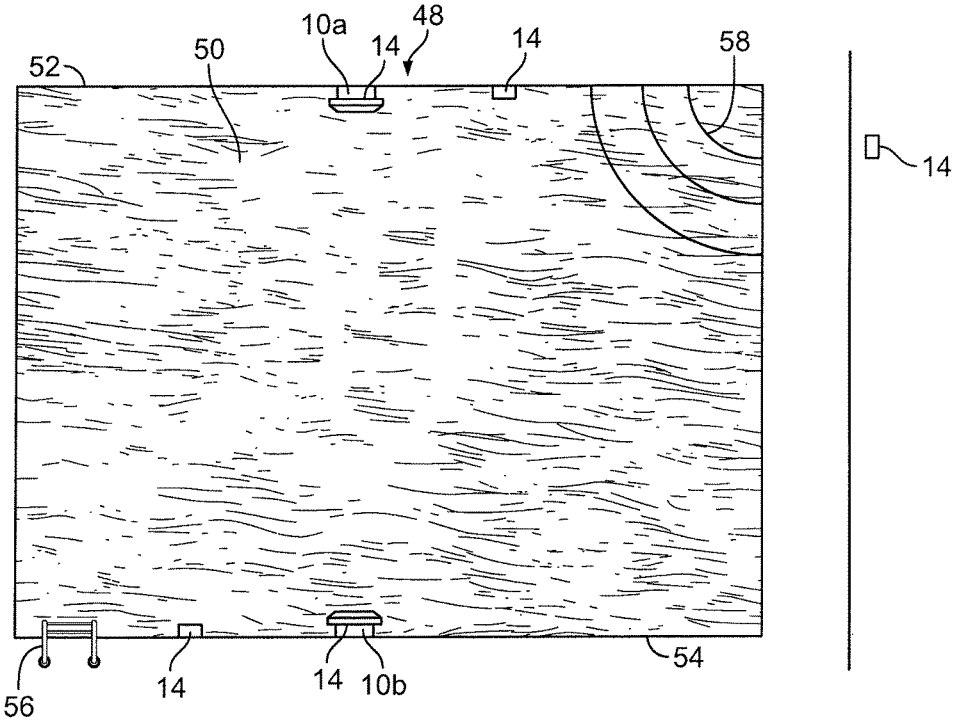
FIG. 4 schematically illustrates a lighting system constructed in accordance with the present disclosure for use in connection with a swimming pool.

FIG. 4 schematically illustrates a lighting system 48 constructed in accordance with the present disclosure for use in connection with a swimming pool 50. More particularly, the lighting system 48 includes light fixtures 10*a*, 10*b* mounted to side walls 52, 54, respectively, of the pool 50. The lighting system 48 could be equipped with a control system (not shown) which is connected to each of the light fixtures 10*a*, 10*b* for controlling the operation of the light fixtures 10*a*, 10*b*. One or more sensors 14 could be located in any desired location, such as in each of the light fixtures 10*a*, 10*b*. Alternatively or additionally, one or more sensors 14 could be located remotely from the light fixtures 10*a*, 10*b*, such as adjacent to the entrances of the pool 50. In the example shown in FIG. 4, sensors 14 are provided near a pool ladder 56, steps 58 that lead into the pool 50, and in each of the light fixtures 10*a*, 10*b*. A sensor 14 could be located outside of the pool 50. One or more sensors 14 could be in communication with one or more light fixtures 10*a*, 10*b* through a wired network or a wireless network. For example, a signal from the sensor 14 located adjacent to the pool ladder 56 could be received by a receiver 24 in the light fixture 10*b*. It will be understood that the number of light fixtures and the number of sensors could vary.

Figure 5:
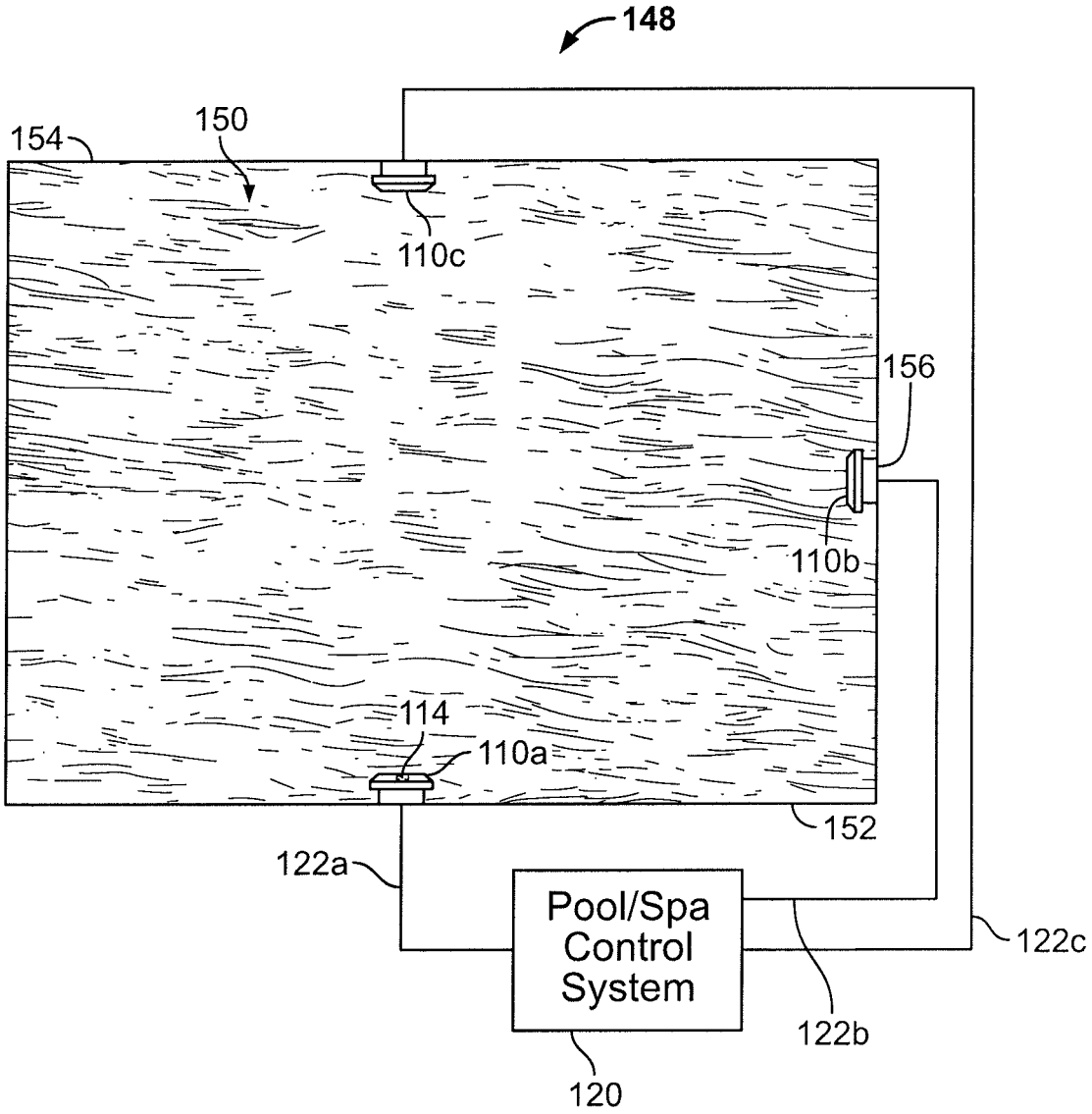
FIG. 5 schematically illustrates a lighting system constructed in accordance with an embodiment of the present disclosure for use in connection with a swimming pool.

FIG. 5 schematically illustrates a lighting system 148 constructed in accordance with an embodiment of the present disclosure for use in connection with a swimming pool 150. More particularly, the lighting system 148 includes light fixtures 110*a*, 110*b*, 110*c* mounted to walls 152, 154, 156, respectively, of the pool 50. The lighting system 148 could be equipped with a control system 120 which is connected to each of the light fixtures 110*a*, 110*b*, 110*c* via power lines 122*a*, 122*b*, 122*c*, respectively, for controlling the operation of the light fixtures 110*a*, 110*b*, 110*c*. A sensor 114 could be located in any desired location, such as in the light fixture 110*a*, as shown in FIG. 5. In this embodiment, the control system 120 utilizes networking between the light fixtures 110*a*, 110*b*, 110*c* through the power lines 122*a*, 122*b*, 122*c*. For example, a signal from the sensor 114 in the light fixture 110*a* could be used to control the light fixtures 110*b*, 110*c* through networking.

In one embodiment, serial RS-485 communications or Power Line Carrier (PLC) technology could be utilized between the control system 120 and the light fixtures 110*a*, 110*b*, 110*c*. Alternatively, the sensor 114 could be in communication with one or more light fixtures 110*a*, 110*b*, 110*c* through a wired network or a wireless network. Any suitable device could be utilized which allows networking and communication of the light fixtures 110*a*, 110*b*, 110*c* with the control system 120.

In one embodiment, the lighting system 48, 148 could include any type of luminaires, such as a dry luminaire located outside of the pool or spa, or a luminaire that is sporadically both wet and dry. Sensors 14, 114 could be installed in each of these luminaires.

Figure 6:
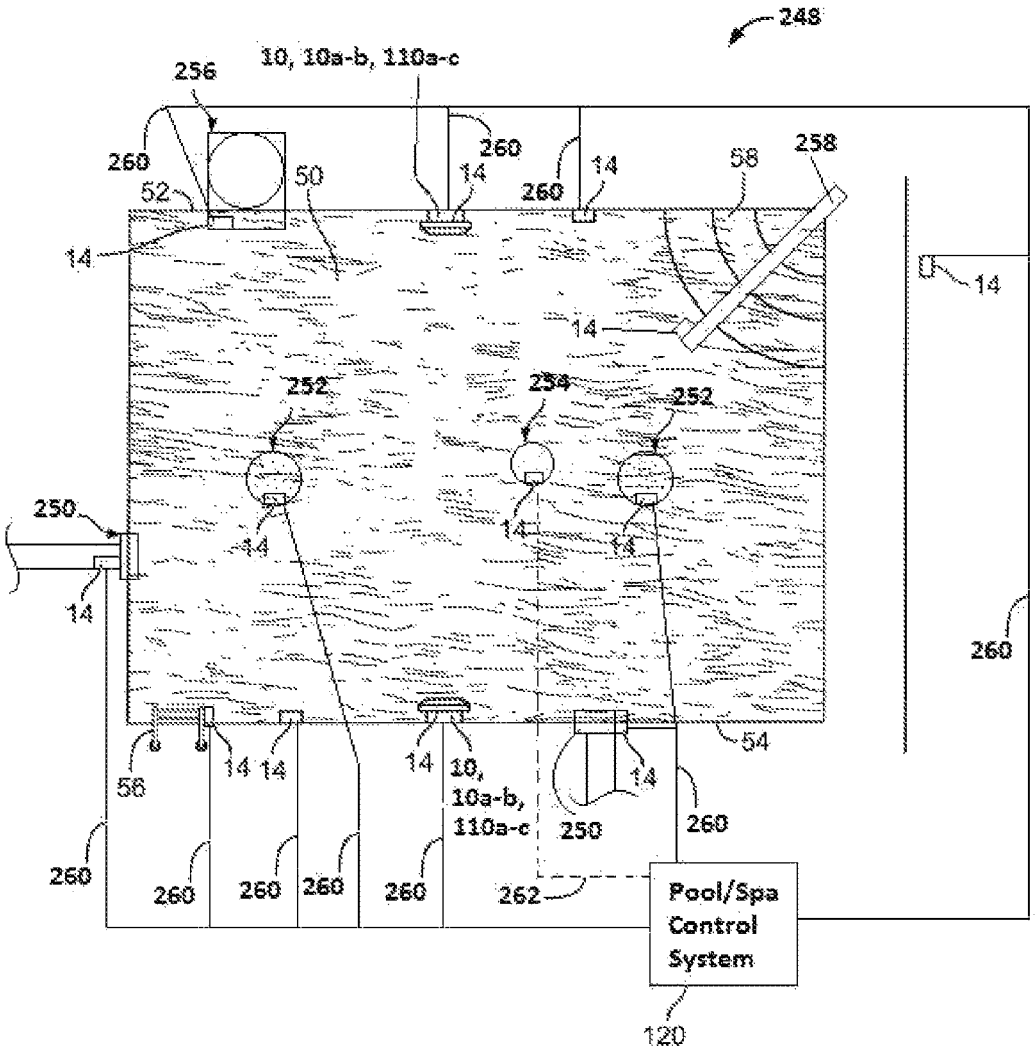
FIG. 6 schematically illustrates a bather condition detection system constructed in accordance with an embodiment of the present disclosure for use in connection with a swimming pool.

FIG. 6 schematically illustrates a bather condition detection system 248 of the present disclosure for use in connection with the swimming pool 50. The bather condition detection system allows for detection of various conditions and/or activity associated with bathers, such as ingress into the pool, egress from the pool, splashing, game playing, drowning, distress, etc., using one or more pool or spa devices having acoustic, motion, pressure, sonar, or optical detection capabilities therein. The bather condition detection system 248 can be similar to the lighting systems 48, 148 shown in and described in connection with FIGS. 1-5, and can include like components which are described and referenced with like element numbers. The bather condition detection system 248 could include one or more light fixtures 10, 10*a-b*, 110*a-c*, one or more return inlet fittings 250, one or more suction outlets 252, a floating wireless chemical sensor 254, and a skimmer 256. As shown in FIG. 6, each of the light fixtures 10, 10*a-b*, 110*a-c*, return inlet fittings 240, suction outlets 252, floating wireless chemical sensor 254, and skimmer 256 can include a sensor 14 associated therewith. Further, the bather condition detection system 248 can include a plurality of sensors 14 that are not associated with any particular pool/spa device and are placed throughout the pool 50, e.g., on the side walls 52, 54, on the pool ladder 56, on a pool rail 258 associated with the steps 58, etc., and outside of the pool 50.

Each of the pool/spa devices, e.g., the light fixtures 10, 10*a-b*, 110*a-c*, return inlet fittings 240, suction outlets 252, floating wireless chemical sensor 254, and skimmer 256, and individual sensors 14 can include the necessary hardware for operation. For example, as shown in FIG. 2, the light fixtures 10 include a receiver 24, a microprocessor 26, a memory 28, and a power supply 30, among other components. Similarly, the other pool/spa devices, e.g., the return inlet fittings 240, the suction outlets 252, the floating wireless chemical sensor 254, the skimmer 256, and the independent sensors 14, can also include a receiver 24, a microprocessor 26, a memory 28, and a power supply 30, as above-described.

In some embodiments, the pool/spa devices can be networked such that they are connected to a pool/spa control system 120 by wires 260, or through a wireless connection 262. For example, as shown in FIG. 6, the floating wireless chemical sensor 254 communicates with the pool/spa control system 120 through a wireless connection 262. However, it should be understood that the light fixtures 10, 10*a-b*, 110*a-c*, return inlet fittings 240, suction outlets 252, skimmer 256, and independent sensors 14 can also communicate with the pool/spa control system 120 through a wireless connection. Alternatively, in place of the pool/spa control system 120, the pool/spa devices could communicate wirelessly with the cloud or a home Wi-Fi network.

In one embodiment of the bather condition detection system 248, the sensors 14 are acoustic sensors, e.g., hydrophones or underwater microphones, that are capable of detecting and receiving underwater sounds/acoustical energy emanating from the pool 50. The acoustic sensors 14 receive the underwater sounds/acoustical energy and sends an audio signal/waveform indicative of these sounds/acoustical energy to the microprocessor 26 for processing. Specifically, the microprocessor 26 is electrically connected to the memory 28, which could have stored thereon an acoustic signature processing algorithm that is used to analyze the audio signal/waveform and determine if a bather condition/activity is present within the pool 50. For example, the microprocessor 26 can analyze the audio signal/waveform using the acoustic signature processing algorithm stored on the memory 28 and determine if a swimmer is entering the pool, exiting the pool, splashing, playing a game, drowning, or in distress. Upon determining that there is a bather condition/activity within the pool 50, the microprocessor 26 can issue a command to perform an action. For example, the microprocessor 26 can instruct the light fixtures 10, 10*a-b*, 110*a-c* to illuminate, change color, or perform a certain light show if it is determined that a bather has entered the pool or if a bather is splashing/playing a game. Alternatively, the action can be to turn off the light fixtures 10, 10*a-b*, 110*a-c* if it is determined that the bather has exited the pool. As another option, the microprocessor 26 can indicate an alarm in order to alert a lifeguard or other individual in the vicinity of the pool 50 if it is determined that a bather is drowning or is in distress. The alarm can be a high volume continuous sound emitted from a speaker, a high volume intermittent sound emitted from a speaker, a change in light output from the light fixtures 10, 10*a-b*, 110*a-c*, flashing the light output from the light fixtures 10, 10*a-b*, 110*a-c*, etc. The alarm can continue until it times out or is manually reset.

In some embodiments, the bather condition/activity determination can be performed by the microprocessor 26 of each individual pool/spa device, e.g., the light fixtures 10, 10*a-b*, 110*a-c*, the return inlet fittings 250, the suction outlets 252, the floating wireless chemical sensor 254, the skimmer 256, and the individual acoustic sensors 14, whereby the microprocessor 26 analyzes the audio signal/waveform. However, in other embodiments, the bather condition/activity determination can be performed by the pool/spa control system 120 or by a remote server or cloud-based system. In such embodiments, the audio signal/waveform can be transferred to the pool/spa control system 120 or the remote server/cloud whereby it is analyzed according to the acoustic signature processing algorithm. The pool/spa control system 120 or the cloud can then send instructions to the necessary components for performing the requested action.

In some embodiments, where the pool/spa devices are networked, the bather condition/activity determination can be based on a plurality of audio signals/waveforms. That is, each of the pool/spa devices, e.g., the light fixtures 10, 10*a-b*, 110*a-c*, the return inlet fittings 250, the suction outlets 252, the floating wireless chemical sensor 254, the skimmer 256, and the individual acoustic sensors 14, can send a respective audio signal/waveform to the pool/spa control system 120 or the cloud, which can analyze all of the audio signals/waveforms together to determine if a bather condition/activity is present. Additionally, the pool/spa control system 120 or cloud could use positional information from each of the pool/spa devices in combination with the respective audio signals/waveforms in order to pinpoint the location in the pool 50 where the bather condition/activity is occurring.

Figure 7:
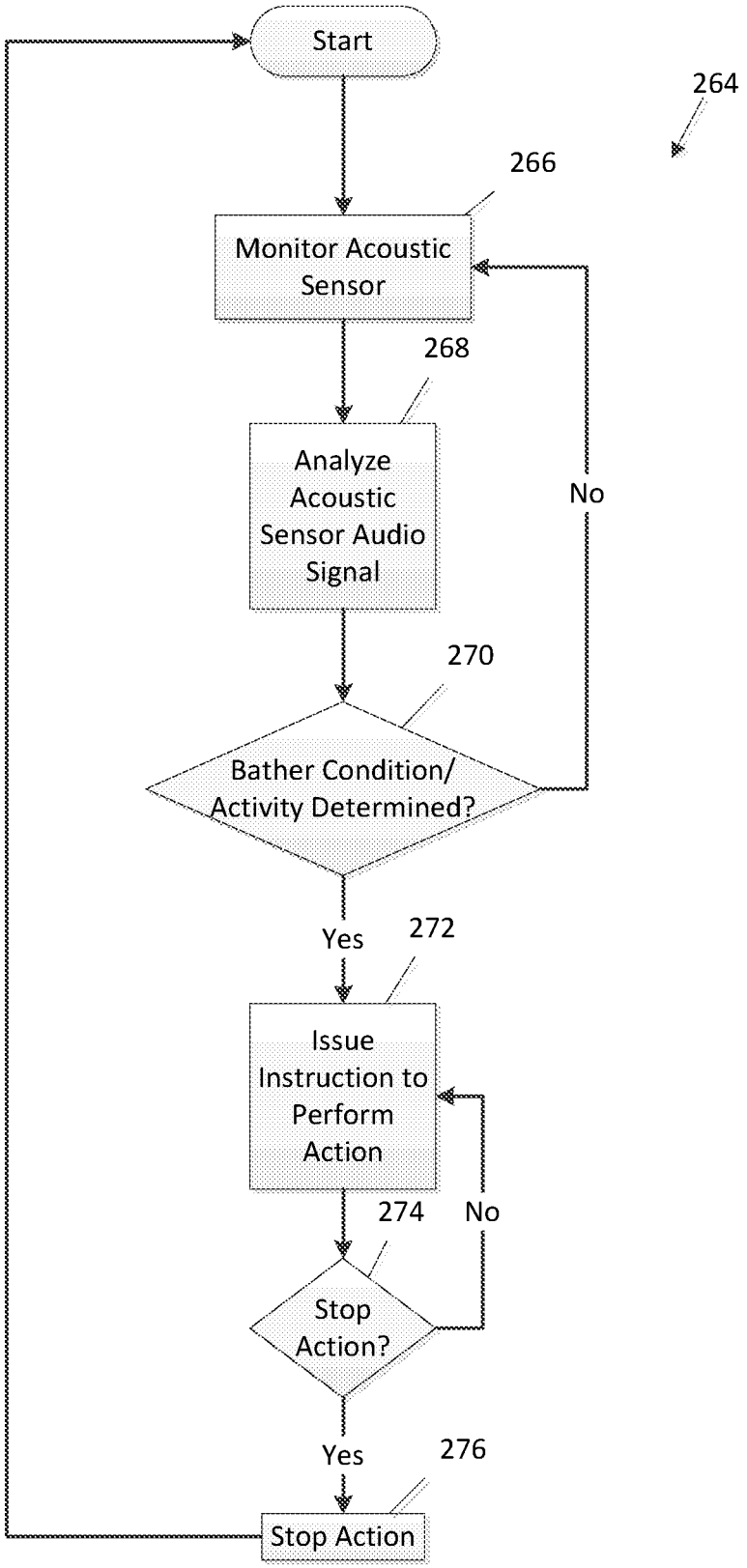
FIG. 7 is a flowchart showing processing steps according to an embodiment of the present disclosure for detecting a bather condition or activity and indicating an alarm based on a detected bather condition.

FIG. 7 is a flowchart showing processing steps according to an embodiment of the present disclosure, indicated generally at 264, for detecting a bather condition/activity and performing an action upon detection of a bather condition/activity. In step 266, the microprocessor 26 of each pool/spa device monitors the acoustic sensor 14. This involves receiving an underwater sound/acoustical energy and converting it into an audio signal/waveform. In step 268, the microprocessor 26 analyzes the audio signal/waveform of the acoustic sensor 14 with the acoustic signature processing algorithm stored on the memory 28. In step 270, a determination is made as to whether a bather condition/activity is present in the pool 50, e.g., a bather has entered the pool, a bather has exited the pool, or if a swimmer is in distress or is drowning. This determination is accomplished through the microprocessor 26 analyzing the audio signal/waveform received from the acoustic sensor 14 according to the acoustic signature processing algorithm. If a negative determination is made, control returns to step 266. If a positive determination is made in step 270, then step 272 occurs, wherein the microprocessor 26 issues an instruction to perform an action. For example, the microprocessor 26 can cause a speaker to emit a high volume continuous sound or a high volume intermittent sound, change the light color or intensity output of the light fixtures 10, 10*a-b*, 110*a-c*, flash the light output from the light fixtures 10, 10*a-b*, 110*a-c*, etc., depending on the bather condition/activity detected. The instruction issued by the microprocessor 26 can be keyed to the specific bather condition/activity detected and determined. In step 44, a determination is made as to whether the action should be stopped. If a negative determination is made, processing reverts to step 272 and the action continues. Otherwise, if a positive determination is made, processing proceeds to step 276 where the microprocessor 26 issues a command to stop the action, and then reverts to step 266. For example, if a user has manually stops the action or if a sufficient amount of time has passed since the start of the action then the system may stop the action and revert to step 266.

It should be understood that while reference is made to the microprocessor 26 in connection with the steps of flowchart 264 shown in FIG. 7, such steps can be performed by the pool/spa control system 120 or by the cloud.

It should also be understood that in some embodiments the sensor 14 can be a motion sensor, a pressure sensor, a wave detection sensor, a sonar detector, a passive sonar detector, an optical sensor, or any other sensor known in the art in place of or in addition to the acoustic sensor. In such embodiments, the audio signal would be replaced by a respective signal generated by the sensor/detector being implemented. The microprocessor 26 would analyze such signal and determine if there is a bather condition/activity based thereon.

While the disclosure has been described in terms of specific embodiments, it is evident in view of the foregoing description that numerous alternatives, modifications and variations will be apparent to those skilled in the art. Accordingly, the disclosure is intended to encompass all such alternatives, modifications and variations which fall within the scope and spirit of the disclosure. What is desired to be protected by Letters Patent is set forth in the appended claims.

What is claimed is:

1. A bather detection system for a pool or spa, comprising:

a pool or spa device positionable at least partially within water of a pool or spa;

an acoustic sensor associated with the pool or spa device and configured to sense underwater sound and produce a signal indicative of the underwater sound; and a processor in communication with the acoustic sensor and configured to analyze the signal to determine at least one of bather ingress or egress in the pool or spa, wherein the processor issues an instruction to perform an action upon the determination of at least one of bather ingress or egress in the pool or spa, and wherein the pool or spa device comprises a floating wireless chemical sensor, the acoustic sensor connected to the floating wireless chemical sensor.

2. The bather condition/activity detection system of claim 1, comprising a memory in communication with the processor.

3. The bather detection system of claim 1, wherein the processor causes a speaker to sound an alarm upon the determination of at least one of bather ingress or egress in the pool or spa.

4. The bather detection system of claim 1, further comprising a light source.

5. The bather detection system of claim 4, wherein the processor causes the light source to change color upon the determination of at least one of bather ingress or egress in the pool or spa.

6. The bather detection system of claim 4, wherein the processor causes the light source to flash upon the determination of at least one of bather ingress or egress in the pool or spa.

* * * * *